US005813413A

United States Patent [19]

Metzner et al.

[11] Patent Number: 5,813,413

[45] Date of Patent: Sep. 29, 1998

[54] METHOD AND PLANT FOR TREATING TOBACCO LEAVES FOR THE PRODUCTION OF CUT TOBACCO

[75] Inventors: Wolfgang Metzner, Hamburg; Bernd Spallek, Syke; Arno Weiss, Norderstedt, all of Germany

[73] Assignee: Brown & Williamson Tobacco Corporation, Louisville, Ky.

[21] Appl. No.: 752,626

[22] Filed: Nov. 19, 1996

[30] Foreign Application Priority Data

Nov. 20, 1995 [DE] Germany ..... 195 43 263.0

[51] Int. Cl.[6] ..... A24B 3/07

[52] U.S. Cl. ..... 131/109.1; 131/290; 131/313

[58] Field of Search ..... 131/109.11, 313, 131/318, 372, 312, 290, 303, 327, 324

[56] References Cited

U.S. PATENT DOCUMENTS

| | | | |
|---|---|---|---|
| 3,734,104 | 5/1973 | Buchanan et al. | 131/140 |
| 3,986,517 | 10/1976 | Broscheit | 131/21 |
| 4,366,823 | 1/1983 | Rainer et al. | 131/291 |
| 4,696,312 | 9/1987 | Turano | 131/109.1 |
| 5,564,444 | 10/1996 | Naylor | 131/290 |

FOREIGN PATENT DOCUMENTS

| | | |
|---|---|---|
| 0 301 217 B1 | 2/1993 | European Pat. Off. . |
| 0 651 951 A2 | 5/1995 | European Pat. Off. . |
| 25 40 411 C2 | 3/1977 | Germany . |
| 27 31 871 | 1/1978 | Germany . |
| 1 555 525 | 11/1979 | Germany . |
| 29 21 025 | 11/1979 | Germany . |
| 33 07 178 A1 | 9/1983 | Germany . |
| 37 10677 C2 | 10/1988 | Germany . |
| 40 29 566 A1 | 3/1991 | Germany . |
| 40 29 567 A1 | 3/1991 | Germany . |
| 695527 | 10/1979 | U.S.S.R. . |
| 951485 | 3/1964 | United Kingdom . |
| 2 026 298 | 2/1980 | United Kingdom . |
| 2 078 085 | 1/1982 | United Kingdom . |
| 2 115 681 | 9/1983 | United Kingdom . |
| 2 118 817 | 11/1983 | United Kingdom . |
| 2 131 671 | 6/1984 | United Kingdom . |
| PCT/SE93/ 00984 | 5/1994 | WIPO . |

*Primary Examiner*—Vincent Millin
*Assistant Examiner*—Charles W. Anderson
*Attorney, Agent, or Firm*—Armstrong, Westerman, Hattori, McLeland & Naughton

[57] ABSTRACT

The invention relates to a method and a plant for the treatment of tobacco leaves for the production of cut tobacco for smokable articles, in which stems and the lamina material of the tobacco leaves are conditioned and cut separately from each other. The conditioned, non-rolled, cut and optionally expanded stems are blended with the conditioned and cut lamina, and the lamina and stems are then jointly conditioned and dried.

21 Claims, 2 Drawing Sheets

METHOD AND PLANT FOR TREATING TOBACCO LEAVES FOR THE PRODUCTION OF CUT TOBACCO

BACKGROUND OF THE INVENTION

1. Field of the Invention

The invention relates to a method as well as a plant for treating tobacco leaves for the production of cut tobacco for smokable articles.

2. Description of the Prior Art

Tobacco leaves, from which smokable articles, particularly cigarettes as well as fine-cut for self-produced cigarettes, are obtained, consist of lamina and stems which, on the one hand, greatly differ in consistency and, on the other, greatly differ in taste and thus influence both the technique in preparing the tobacco and the taste perception of the respective smokable article to a very great extent, albeit differingly.

To get round the problems associated with the treatment of stems and the effects in taste caused by the stems, it is thus usual to separate the stems from the lamina and to use only the lamina for the production of cigarettes. Due to the percentage of stems in the overall weight of the tobacco leaves making up to roughly 30% by weight, this method represents, however, a very costly waste of the valuable "tobacco leaf" raw material.

This is why it has already been attempted to process whole tobacco leaves by specific methods of size reduction employing shear forces into a flowable blend of lamina particles and stem particles which may be put to use directly in cigarette production. This method, described for example in DE 40 29 566 A1, has, however, never been put into practice, since the taste properties failed to come up to expectations.

A mixed solution is disclosed by DE 40 29 567 A1 in which whole leaves are processed into a blend of lamina particles and substantially intact stem pieces in a method of size reduction employing shear forces; the stem pieces need to be subsequently separated out, the lamina particles then being directly supplied to cigarette production. Transferring this method into actual practice also failed due to the taste problems still waiting to be solved.

A further method is disclosed by GB 2,026,298 A in which tobacco leaves are reduced in size to particles which are suitable for cigarette production. By means of an air separating method the leaf particles are fractionated into a more heavy fraction containing the stems and a lighter lamina fraction free of stems, the heavier fraction being threshed, so as, in this case too, to still separate the lamina from the stems. The separated lamina and the lighter fraction originally obtained are then blended to be supplied to cigarette production. This method is highly complicated, the same also applying to the similar method according to U.S. Pat. No. 4,696,312.

It is thus still the usual practice to disintegrate the tobacco leaves into stems, on the one hand, and lamina, on the other, which is usually done in the country of origin shortly after harvesting. Stems and lamina are packaged separate from each other and shipped to the place of deployment where the so-called "primary tobacco preparation" is done. In this tobacco preparation the stems, on the one hand, and the lamina, on the other, are treated separately from each other, namely conditioned, i.e. subjected to moisture and heat treatment, cut and dried, before being finally blended and then subjected jointly to further processing, as a rule involving the addition of flavoring materials.

The basic principles of this method, by which both fine-cut and also cigarettes can be produced are described in the book "Tobacco Encylopedia" published by Ernst Voges, 1984, in the article "Cigarette Manufacture I and II", more particularly under the heading "The Production of Cut Tobacco".

The drawback in this generally used method is that in the primary tobacco preparation the stems, on the one hand, and lamina material, on the other, need to be run on processing lines totally separated from each other, in the so-called "stem line" and the so-called "lamina line", each of which comprise conditioning means, cutting means, saucing means for applying casings, heating means and driers. On the stem line rolls are also needed for the purpose of rolling out the stems prior to the cutting procedure to generate the "CRS", i.e. the cut and rolled stem pieces which are then added to the lamina material directly upstream of the flavor drum.

Both the costs of the investments for these two separate lines and the costs involved in running these two lines are high.

SUMMARY OF THE INVENTION

The invention is thus based on the object of providing a method and a plant for the treatment of tobacco leaves for the production of cut tobacco for smokable articles of the type given in which the aforementioned drawbacks are not encountered.

In particular it is intended to propose a method and a plant which permit the production of cut tobacco which are simple and thus both as regards the costs of investment and regarding the operating costs are more cost-effective, permitting processing into either cigarettes, cigarillos or cigars or fine-cut.

This object is solved according to the invention by a method of treating tobacco leaves for the production of cut tobacco for smokable articles, wherein the conditioned, unrolled and cut stems and the conditioned and cut lamina are blended, and the cut stems and the cut lamina are then jointly conditioned and dried, and by a plant for the treatment of tobacco leaves for the production of cut tobacco for smokable articles, comprising a conditioning means for the stems of the tobacco leaves separated from the lamina leaves, a conditioning means for the lamina of the tobacco leaves, a cutting means for the stems and the lamina, and driers for the stems as well as the lamina, wherein a conditioning means is provided for a blend of the said conditioned, non-rolled, cut stems and said conditioned and cut lamina material, and at least one drier is provided for said conditioned blend of lamina material and stems.

Advantageous forms of embodiments are defined by the respective sub-claims.

The advantages achieved by the invention are based on the fact that only a relatively small proportion of the "stem line" employed hitherto, namely a short stem line including a conditioning means and a stem cutter, are employed, whilst the rolls, the moisturizing and the heating means as well as the drier for the stems can be eliminated. The savings made possible thereby both as regards investments and operating costs, particularly as regards personnel, are considerable.

In addition, the measures claimed permit homogenous blending of lamina and stem material so that a highly consistent taste perception materializes.

Furthermore, the degree to which use is made of the raw tobacco is higher since due to the pronounced shortening in the length of the stem line much less dust materializes, i.e.

the valuable "tobacco leaf" raw material is made use of very much more effectively. This is also contributed to by the fact that no drier is needed in the short stem line which, as is known from experience, contributes towards tobacco degradation.

At the same time, yet a further cost-saving feature is involved, since it is usually the case that winnowings and dust are collected, conditioned and returned to tobacco preparation. These steps can be eliminated due to the extremely minor amount of winnowings and dust occurring on the short stem line.

It is usually such that the tobacco stems and/or the lamina are provided with a casing. Although the corresponding saucing means, in principle, may be arranged at any suitable location in tobacco preparation and both the stem and the lamina material can be provided with a casing, it has turned out to be particularly expedient when only the lamina is provided with the casing. The casing is then done preferably after lamina conditioning by means of a saucing means.

It has been found to be expedient when the stems prior to cutting are conditioned to a moisture content of approximately 22% to approximately 26%, particularly approximately 24%. These values apply to the % by weight moisture on a wet basis. The method of determining moisture is oven drying for 3 hours at 80° C. The moisture values according to the invention represent, as compared to a stem moisture content of approximately 30%, as cited in the "Tobacco Encyclopedia", a substantial improvement, since, on the one hand, the relative high moisturization is problematic and, on the other, the moisturizing necessary in this case also reduces the expense of later drying. In addition to this, stems premoisturized merely relatively slightly may be left standing longer without their properties changing to any remarkable degree, whilst the storage time for stems having a moisture content of approximately 30% is greatly restricted.

It has been found to be expedient when, before cutting, the conditioned stems are held covered, i.e. in a closed environment, for at least 1.5 hours, particularly approximately 2 hours, to ensure a consistent moisturization.

The stems may be additionally provided with a casing. This may be done by a saucing means either prior to stem conditioning or after leaving the cutter.

The stems are cut to a cutting width of approximately 0.1 to approximately 0.3 mm, particularly approximately 0.2 mm.

If necessary—in modern cigarettes expanded tobaccos which take up a greater volume per unit of weight are finding increasing application for reasons of reducing costs—the stems should be expanded. This is done expediently after cutting the stems, an expansion device being employed as is known, for example, from German patent no. 37 10 677.

Whilst the short stem line according to the invention works substantially with the same values both for cigarettes and for fine-cut, a distinction needs to be made between fine-cut and cigarettes as regards conditioning the lamina. Thus, for cigarette production the lamina is conditioned to a moisture content of approximately 17 to approximately 25%, particularly approximately 17.5%, whilst for fine-cut production the lamina is conditioned to a moisture content of approximately 23 to approximately 25%, particularly approximately 24%.

Again, in cutting the lamina a distinction needs again to be made between fine-cut production and cigarette production. In cigarette production the lamina needs to be cut with a cutting width of approximately 0.5 to 2 mm, particularly approximately 0.85 mm, whilst in fine-cut production the cutting width should lie in the range of approximately 0.35 mm to approximately 0.5 mm, particularly approximately 0.45 mm.

The blending ratio between cut lamina and cut stems may be varied, depending on the requirements on the smokable article to be produced. Thus, lower priced product variants receive a higher stem percentage, for instance. For branded cigarettes the stem percentage of 30%, relative to the mass a whole, is not exceeded usually, it being in particularly in the range of approximately 5% to 25%.

After being cut the stem and lamina materials are blended, conditioned, i.e. heated and moisturized, preferably in a so-called conditioning cylinder operating with water and steam, to achieve a moisture content in the range of approximately 18 to 39%, particularly approximately 19.5 to approximately 24%, preferably approximately 22.5%.

Subsequently, the blend is dried, expediently in a hot-air drier which brings the moisture content of the blend to approximately 14%.

This is followed by the usual further processing of the material, depending on its intended application, i.e. cigarette production or fine-cut production.

BRIEF DESCRIPTION OF THE DRAWINGS

The invention will now be explained in detail on the basis of embodiments with reference to the attached schematic drawings in which.

DESCRIPTION OF THE PREFERRED EMBODIMENTS

Figure 1:
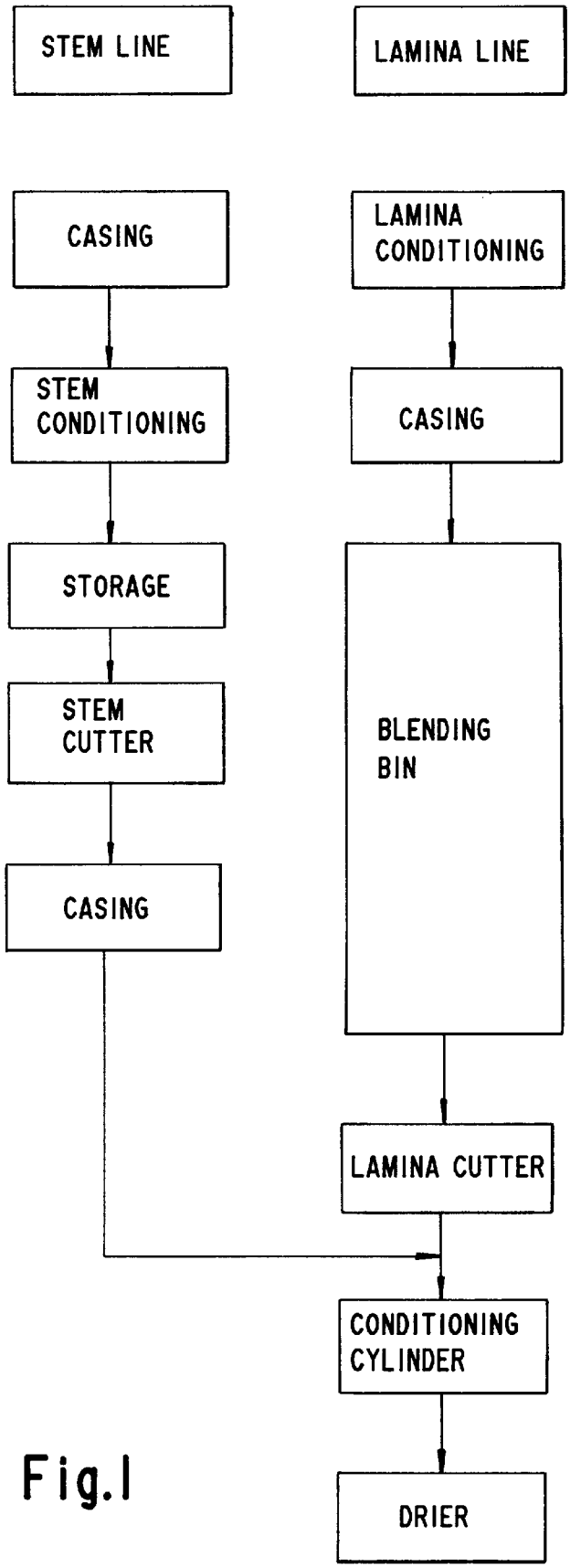
FIG. 1 shows a first embodiment of a plant for producing cut tobacco for cigarettes.

The plant shown in FIG. 1 processes stems, on the one hand, and lamina, on the other, which have been separated from each other in a prior stage not shown, often in the country of origin of the tobacco leaves, and are now to be fed to the stem line, on the one hand, and the lamina line, on the other, of this plant. In this arrangement the optional devices are indicated by dotted boxes.

The stems reach a saucing means in which they are provided with casings before entering a steam tunnel serving as a conditioning means which operates with water and steam so that the stems leave the conditioning with a moisture content of approximately 24%.

The conditioned stems are held covered for roughly 2 hours and are then fed to a stem cutter. The preferred cutting width is about 0.2 mm.

The cut stems are, where necessary, provided again with a casing, only one of the two saucing means being needed as a rule.

The conditioned and cut stems provided with a casing are thereafter blended with the cut lamina which has passed through its own lamina line.

This lamina line comprises a conditioning means formed by a steam drum and in which the lamina material receives for cigarette production a moisture content of approximately 17.5% and for fine-cut production a moisture content of approximately 24%.

A saucing means for the conditioned lamina is provided downstream of the conditioning means to which a blending bin for the lamina is connected downstream.

The conditioned lamina arrives from the blending bin to a lamina cutter which is adjusted for the production of cigarettes to a cutting width of approximately 0.85 mm and for the produciton of fine-cut to a cutting width of approximately 0.45 mm. The moisture of the lamina in the lamina cutter varies practically not at all.

The cut lamina and the cut stems are blended with each other behind the lamina cutter, the proportion of the stems in the blend being at approximately 14% stem material, based on the blend as a whole.

The blend of lamina material and stems reaches a conditioning cylinder where it is moisturized with water and steam and heated so that it leaves the preheating cylinder with a moisture content of approximately 22%.

Subsequently, this blend is dried in a hot-air drier from which it emerges with a moisture content of approximately 13–16%, preferably about 14%, and is then forwarded to the further steps of the primary tobacco preparation, for example a cooling and sieve drum as well as a flavor drum.

Figure 2:
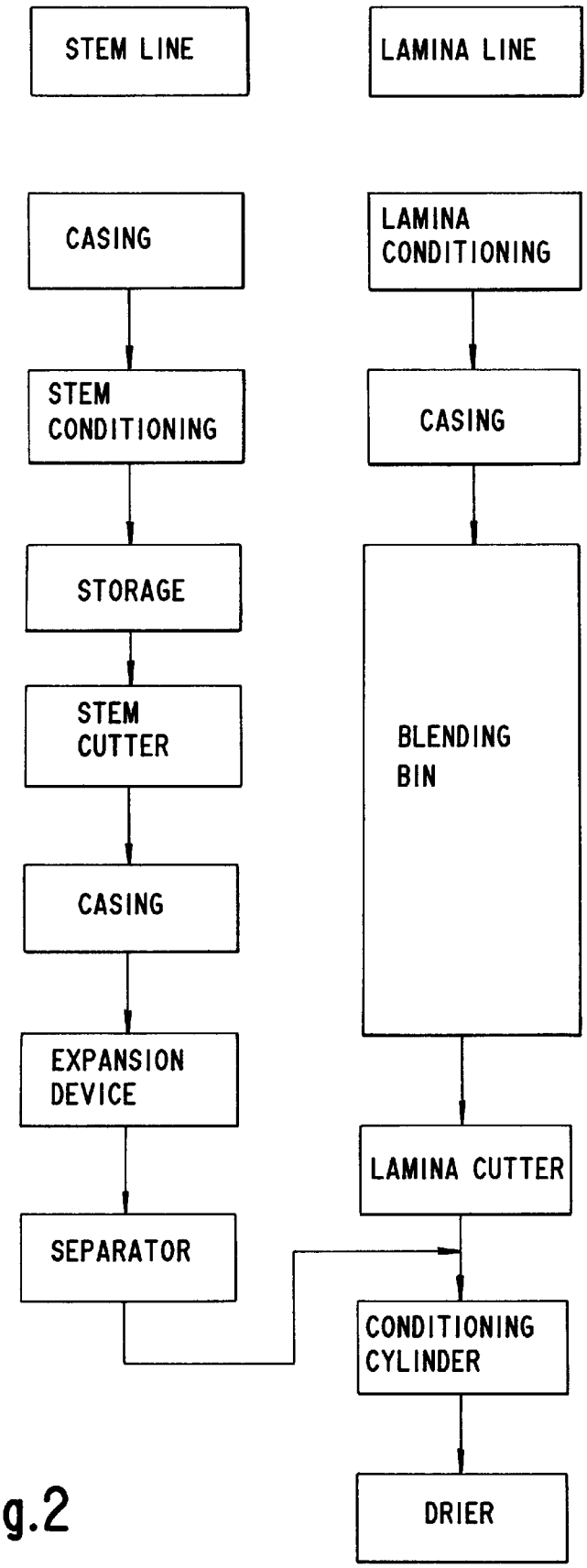
FIG. 2 shows a somewhat modified embodiment of the plant shown in FIG. 1.

The modified embodiment shown in FIG. 2 differs from the embodiment shown in FIG. 1 merely by the conditioned, non-rolled and cut stems being further subjected to an expansion method, as is known, for example, from the German patent no. 37 10 677. From the expansion device the expanded stems are supplied to a separator which separates the fluid used for expanding. For this purpose the separator as set forth in European patent no. 0 301 217 may be employed. These cut and expanded stems are then blended with the cut lamina so that the lamina and the expanded stems are jointly subjected to the following process steps, already described above.

What is claimed is:

1. A method of treating tobacco leaves for the production of cut tobacco for smokable articles, comprising:

providing unrolled and cut stems which have been conditioned to provide a moisture content of between about 22–26% moisture and a width of between about 0.1–0.3 mm, and conditioned and cut lamina which have been conditioned to provide a moisture content of between about 17–25% moisture and a width of between about 0.5–2 mm;

blending said unrolled and cut stems after said conditioning with said conditioned and cut lamina;

conditioning said resultant blend to adjust the moisture content of the blend to between about 18 to 39% moisture; and drying said conditioned blend to a moisture content of between about 13–16% moisture.

2. The method as set forth in claim 1, wherein the tobacco stems prior to or after the cutting and/or the lamina after the conditioning are provided with casing.

3. The method as set forth in claim 1, wherein said conditioned stems, prior to cutting, are stored for at least 1.5 hours.

4. The method as set forth in claim 3, wherein the storage of the conditioned stems is carried out in a closed environment.

5. The method as set forth in claim 1, wherein said cut stems are expanded.

6. The method as set forth in claim 1, wherein for fine-cut production the lamina material is conditioned to a moisture content of approximately 23 to approximately 25%.

7. The method as set forth in claim 1, wherein maximum 30% cut stems, relative to the quantity as a whole, are added to said lamina material.

8. The method as set forth in claim 1, wherein for cigarette production the lamina material is cut with a cutting width of approximately 0.5 to 2 mm.

9. The method as set forth in claim 1, wherein for the fine-cut production the lamina is cut with a cutting width of approximately 0.35 mm to approximately 0.5 mm.

10. The method as set forth in claim 1, wherein said blend of lamina material and stems is conditioned to a moisture content of approximately 19.5% to approximately 24%.

11. A plant for the treatment of tobacco leaves for the production of cut tobacco for smokable articles, comprising:

a) a conditioning means for non-rolled stems of tobacco leaves separated from lamina leaves, b) a conditioning means for the lamina of the tobacco leaves, c) a cutting means for the stems and the lamina, and d) driers for the stems as well as the lamina, wherein e) a conditioning means is provided for blending of the said conditioned, non-rolled, cut stems and said conditioned and cut lamina material, and f) at least one drier is provided for said resultant conditioned blend of lamina material and stems.

12. The plant as set forth in claim 11, wherein a saucing means for casing said stems is provided.

13. The plant as set forth in claim 12, wherein said saucing means is connected upstream of said means for conditioning said stems or downstream of said stem cutting means.

14. The plant as set forth in claims 11, wherein a saucing means for casing said lamina is provided.

15. The plant as set forth in claim 14, wherein said saucing means is disposed between the conditioning means for the lamina and the stem cutting means.

16. The plant as set forth in claim 11, wherein a preheating means is provided for said blend of lamina material and stems.

17. The plant as set forth in claim 16, wherein said preheating means is a conditioning cylinder.

18. The plant as set forth in claim 16, wherein a drier is connected downstream of said preheating means.

19. The plant as set forth in claim 18, wherein said drier is a hot air drier.

20. The plant as set forth in claim 20, wherein an expansion device is provided for the cut stems.

21. The plant as set forth in claim 19, wherein a separator for the air used in expansion is connected downstream from said expansion device.

* * * * *